US010265572B2

(12) United States Patent
Bach et al.

(10) Patent No.: US 10,265,572 B2
(45) Date of Patent: Apr. 23, 2019

(54) EXERCISE DEVICE

(71) Applicant: James Christopher Bach, Chicago, IL (US)

(72) Inventors: James Christopher Bach, Chicago, IL (US); Jonathan M. LaVieri, Chicago, IL (US)

(73) Assignee: James Christopher Bach, Chicago, IL (US)

( * ) Notice: Subject to any disclaimer, the term of this patent is extended or adjusted under 35 U.S.C. 154(b) by 0 days.

(21) Appl. No.: 15/452,990

(22) Filed: Mar. 8, 2017

(65) Prior Publication Data

US 2017/0173379 A1 Jun. 22, 2017

Related U.S. Application Data

(63) Continuation of application No. 14/922,839, filed on Oct. 26, 2015.

(Continued)

(51) Int. Cl.

| | |
|---|---|
| ***A63B 21/00*** | (2006.01) |
| ***A63B 22/00*** | (2006.01) |
| ***A63B 23/04*** | (2006.01) |
| ***A63B 23/12*** | (2006.01) |
| ***A63B 24/00*** | (2006.01) |

(Continued)

(52) U.S. Cl.

CPC .... *A63B 22/0017* (2015.10); *A63B 21/00069* (2013.01); *A63B 21/0087* (2013.01); *A63B 21/156* (2013.01); *A63B 21/4009* (2015.10); *A63B 21/4011* (2015.10); *A63B 21/4013* (2015.10); *A63B 21/4017* (2015.10); *A63B 21/4035* (2015.10); *A63B 21/4043* (2015.10); *A63B 23/0355* (2013.01); *A63B 23/03508* (2013.01); *A63B 24/0075* (2013.01); *A63B 24/0087* (2013.01); *A63B 71/0619* (2013.01); *A63B 21/4033* (2015.10); *A63B 23/0405* (2013.01); *A63B 23/1209* (2013.01);

(Continued)

(58) Field of Classification Search

CPC ..... A63B 21/0085–21/0087; A63B 21/154; A63B 21/156; A63B 21/4045; A63B 21/002–21/0023

See application file for complete search history.

(56) References Cited

U.S. PATENT DOCUMENTS

| | | | |
|---|---|---|---|
| 4,257,593 | A | 5/1981 | Keiser |
| 4,500,089 | A | 2/1985 | Jones |

(Continued)

*Primary Examiner* — Jennifer M Deichl

(74) *Attorney, Agent, or Firm* — Loza & Loza, LLP; Heidi L. Eisenhut

(57) ABSTRACT

An exercise device that includes a frame, a user interface; a connection cable and a plurality of components that provide resistance to the cable and user interface. These components include a programmable, driven carriage capable of vertical movement between first and second positions and including one or more pulleys mounted thereon, wherein the cable extending away from the first end and user interface passes around the one or more pulleys on the carriage, a slider mechanism moveable between first and second positions and including one or more pulleys mounted thereon, and a pneumatic resistance device that is secured to the frame and that is operatively associated with the slider mechanism to provide resistance to slider mechanism movement between the first and second positions.

16 Claims, 3 Drawing Sheets

Related U.S. Application Data

(60) Provisional application No. 62/073,483, filed on Oct. 31, 2014.

(51) Int. Cl.
*A63B 71/06* (2006.01)
*A63B 21/008* (2006.01)
*A63B 23/035* (2006.01)

(52) U.S. Cl.
CPC . *A63B 2022/002* (2013.01); *A63B 2022/0041* (2013.01); *A63B 2225/093* (2013.01)

(56) References Cited

U.S. PATENT DOCUMENTS 5,076,574 A 12/1991 Johnson, Jr.
5,529,552 A 6/1996 Biedermann et al.
5,776,040 A 7/1998 Webb et al.
6,267,735 B1 7/2001 Blanchard et al.
6,413,195 B1 7/2002 Barzelay
6,447,430 B1 9/2002 Webb et al.
6,482,134 B1 11/2002 Rasmussen
6,770,015 B2 8/2004 Simonson
7,172,538 B2 2/2007 Keiser
7,201,712 B2 4/2007 Tiahrt
7,291,100 B2 11/2007 Dodge et al.
7,335,141 B2 2/2008 Piane, Jr.
7,682,295 B2 3/2010 Hulls
7,686,749 B2 3/2010 Keiser
7,722,509 B2 5/2010 Eder
7,762,934 B1 7/2010 Munson, Jr. et al.
7,887,468 B2 2/2011 Ross et al.
7,955,235 B2 * 6/2011 Keiser ..... A63B 21/0087 482/112
8,172,733 B1 5/2012 Batca
2013/0184128 A1 7/2013 Towley
2014/0038777 A1 * 2/2014 Bird ..... A63B 21/0058 482/5
2014/0121071 A1 * 5/2014 Strom ..... A63B 21/062 482/99

* cited by examiner

EXERCISE DEVICE

This application is a Continuation of copending U.S. patent application Ser. No. 14/922,839, filed Oct. 26, 2015, which claims the benefit of U.S. application Ser. No. 62/073,483 filed Oct. 31, 2014, the entire contents of which applications are expressly incorporated herein by reference in their entireties.

BACKGROUND

The present invention relates to an exercise apparatus and, more particularly, to an adjustable exercise apparatus that can be used for a various exercise routines. The present invention particularly pertains to an exercise apparatus for stimulating different muscles and muscle fibers by continuously changing the axis point of the user interface of the device, thus providing differing trajectories that require different responses by the different muscle or muscle groups. The exercise becomes more challenging due to the repeated change of the axis point throughout the exercise program.

Staying physically active and exercising is an essential part of life, as maintaining an active life-style not only replenishes a person's state of mind by releasing chronic tension and increasing self-awareness, but also ensures that chronic diseases and various other ailments are effectively kept in check. It is clear, that as the incidence of debilitating medical conditions such as but not limited to heart and cardiovascular diseases diminish due to an improved public awareness regarding maintaining a healthy life-style and regular physical activity, there is still an unmet need for improved fitness exercise apparatuses from the perspective of actively exercising individuals, that greatly aide in working out multiple muscle groups at the same time and improvement of their physical form.

Many exercise devices in the prior art have been developed that use weights to provide resistance to the exertion of muscular force. Such machines commonly employ weight stacks that allow a user to vary the weight lifted during the exercise.

Pneumatic exercise equipment has also been developed to simulate the desired characteristics of a weight stack exercise machine by easily permitting the weight lifter to increase or decrease the resistance. These pneumatic exercise machines are advantageous because they permit the weight lifter to increase speed without the resistance changing because such machines do not have a significant inertia of motion. Consequently, pneumatic exercise equipment ensures full muscular effort throughout the stroke. There exists a number of United States patents are examples of such machines and devices.

U.S. Pat. No. 7,887,468 discloses a resistance system for fitness equipment, which includes a carriage 26, which includes a series of pulleys 116 mounted at the lower end. A weight cable 118 connects the individual weight blocks 114 to the carriage 26 by way of the respective pulley 116. This system is disclosed with resistance cords only, but the same system can be used with a number of resistance sources including weights, springs, pneumatic and hydraulic cylinders, or any spring material and configuration which allows for the storage of mechanical energy stretching, bending, twisting or other physical deformation.

U.S. Pat. No. 7,762,934 discloses exercise apparatus based on a variable mode hydraulic cylinder which delivers a controllable fast acting force. The invention uses a hydraulic cylinder with features that allow high acceleration rates, rapid changes of force level and direction, and positive fierce limitation. In the preferred embodiment, the hydraulic cylinder is composed of a rod-less, hydraulic cylinder coupled to a cable and pulley system. A water source delivers water to generate a force against an inner bi-directionally moving piston to generate a regulated movement.

U.S. Pat. No. 7,335,141 discloses an exercise apparatus (10) has two cables (12a-b) having a proximate end and a distal end. The proximate end of each cable is connected to a handle (14a-b), respectively, designed to be pulled by a user. The distal end of each cable (12a-b) is coupled to a resistance source (16a-b) which may be a weight stack, a spring, an elastic band, a hydraulic or pneumatic damper; e.g., a piston in a cylinder, or a combination of one or more weights, springs and dampers. Cables (12a-b) pass through at least three pulleys: a first pulley (18a-b) carried on trolleys (20a-b); a central second pulley (22a-b), and an upper third pulley (24a-b) mounted on a frame above the respective resistance source (16a-b). The central pulleys (22a-b) are fixedly mounted adjacent each other in the vicinity of a substantially horizontal, imaginary axis 30 and trolleys (20a-b) can be moved without adjusting the lengths of respective cables (12a-b). As the trolleys (20a-b) are moved, the lengths of the cables between their proximate ends at handles 14a-b) and the portions which pass around the pulleys (18a-b) remain substantially constant.

U.S. Pat. No. 7,722,509 discloses a handicapped accessible exercise apparatus having a central housing with two pivoting extension arms. Cables extend from weight stacks within the housing to movable cable guides on the arms for engagement by a user. By adjusting the positions of the arms and the cable guides, the apparatus can be configured to facilitate various exercises and to accommodate users of various sizes. The apparatus is provided with button-operated locks for allowing users with limited manual dexterity to easily lock and unlock the positions of the extension arms and the cable guides.

U.S. Pat. No. 7,682,295 discloses an exercise apparatus provides multiple resistance patterns by a cable attached to a pulley, including a linear axis, which is referred to as path of travel. Changing resistance patterns in an exercise apparatus is accomplished by moving a cable pivot point within a channel. The channel may take the form of numerous shapes. Multiple shapes may comprise one continuous channel. The placement of the pivot point and surrounding channel shape dictate the resistance pattern along the range of exercise motion. The pivot point is attached to two cables, one leading to a weight, the other leading to the user of the exercise apparatus.

U.S. Pat. No. 7,291,100 teaches a sports apparatus, which can provide a variable resistance to a user. A resilient panel can be adjusted for custom resistance. The resilient panel is provided with pulleys and cables arranged to deflect the panel when a user provides a force on the cable. The user can transmit force to the resilient panel by attaching a suitable exercise implement to the cable. The resilient can also be arranged as required by the type of exercise and for convenience.

U.S. Pat. No. 7,201,712 discloses an exercise device with variable resistive force may include a variety of means such as pneumatic or hydraulic pumps and programmable controllers therefore, as well as specially designed lead pulleys as described herein above can be employed to cause the resistive force to oscillate in magnitude and/or direction during a repetition. With the use of programmable computer means, the waveform and/or the frequency of oscillations in the resistive force can also be made to fluctuate.

U.S. Pat. No. 6,770,015 is directed to an exercise apparatus that includes a frame housing a weight stack. A sliding assembly is coupled to the frame and weight stack. The sliding assembly includes, but is not limited to, a guide column, a sliding element disposed on the guide column, a pulley attached to the sliding element, a first mount disposed at one end of the guide column, a second mount coupled to the sliding element, and a first cable disposed in the pulley. The first cable has a first end attached to one end of the guide column, an intermediate portion disposed in the pulley, and a second end terminating in a handle. A second cable may have a first end attached to the sliding element or the first mount and a second end attached to the weight stack. In one embodiment, the guide column, first mount, and second mount are rotatable independently of each other.

U.S. Pat. No. 6,482,134 discloses a total body exercise apparatus including a body support sled, hand rings and hydraulic and weighted resistance. A line trolley, suspended from a header by an assembly of pulleys and lines, tracks on a pair of rails, to pivotally support the upper end of the sled frame. At its lower end the sled is pivotally joined to a frame mounted radial indexing apparatus. That apparatus operatively positions a set of front and rear foot platforms, linked to the sled, to transmit leg force and assist in its elevation.

U.S. Pat. No. 6,447,430 relates to an exercise apparatus having a frame with a pair of upstanding sections disposed substantially at right angles to each other, a weight stack mounted on each of the frame sections, a cable coupled to each of the weight stacks for transferring a pull on the cable to the weights in the stack, a pulley block through which the cable is pulled, a leg connected to each of the frame sections for movement between a supporting position and a storage position, interlock means between the legs and respective ones of the weight stacks for preventing the weights from being raised when the legs are in the storage position, a bench, which is connected to the frame and can be folded up between the two frame sections for storage, a carriage mounted on each of the frame sections and adapted to be positioned at different heights, and means mounting one of the pulley blocks on each of the carriages such that each of the pulley blocks is free to pivot about two axes of rotation so that the pulley block can follow the cable and remain aligned with the cable regardless of the direction in which the cable is pulled.

U.S. Pat. No. 6,267,735 discloses a therapeutic continuous passive motion device moves a patient's leg through a plurality of cycles of motion. A "Comfort Zone" range of motion feature allows an operator to temporarily increase the flexion angle (or decrease the extension angle), and the device will automatically decrease the flexion angle (or automatically increase the extension angle) at a predetermined rate over a period of treatment time, so that the device may return to operation between the preset operational limits of the range of motion. In one embodiment not shown in the figures, the drive means may include a pulley and a cord mounted thereon, which cord is adapted to be moved along the axis of the frame by operation of the motor. In such embodiment, the driver is attached to the cord and is adapted to move along the axis of the frame as the cord is moved by operation of the motor. In another embodiment, the drive means may be a piston mounted in the frame and disposed along the axis thereof, having a piston rod adapted to be moved along the axis of the frame by operation of a pump, and the driver is attached to the piston rod and is adapted to move along the axis of the frame as the piston is operated by the pump.

U.S. Pat. No. 5,776,040 teaches an exercise apparatus has an auxiliary weight system which can be used with virtually any exercise apparatus irrespective of its stroke length and which is relatively free of resistance due to friction caused by the interaction of the weights and their guide rods. The exercise apparatus of the present invention includes: a frame; an exercise arm attached to and movable relative to the frame; a set of first weights, each of which is of a first magnitude; a first moving unit for moving at least one of the set of first weights along a first path; a set of second weights, each of which is of a second magnitude that differs from the first magnitude; a second moving unit for moving at least one of the set of second weights along a second path that is non-coincident with the first path; and an interconnecting assembly for interconnecting the first and second moving units with the exercise arm such that movement of the exercise arm draws at least one of the first set of weights and at least one of the second set of weights along, respectively, the first and second paths.

U.S. Pat. No. 5,529,552 discloses an exercise apparatus, which comprises a support platform comprising an exercise and/or support surface formed by a plurality of modular members which may be interconnected to increase or decrease the size of the exercise surface, first and second utility arms extending from opposite sides of the support platform. Each of the utility arms comprises an upper segment pivotally connected to a lower segment. The upper segment may comprise one or more pulleys and corresponding ropes which may be pulled by a person against a selectable resistance provided by an accommodating resistance system embedded within the support platform. The resistance system includes a hydraulic chamber filled with an incompressible fluid medium, a piston, a channel, and a relief valve, whereby one can selectively change the resistance in infinitely small increments. A computer system provides information regarding resistance exercises.

U.S. Pat. No. 5,076,574 discloses a portable, stable motorless rope-climbing exercise apparatus comprises a stable support frame, a plurality of rope pulleys and rope guides mounted on the frame, an endless rope extending around the pulleys and guides to form a path which includes a vertically extending rope climbing portion, and hydraulic braking assembly coupled to the pulley system for controlling the rate of movement of the rope based upon the weight of the user when the user is climbing the rope.

U.S. Pat. No. 4,500,089 teaches a saddle-type seat for supporting the user in substantially an upright position with the legs being maintained in position during use of the apparatus. A user-actuated lever is provided with a padded roller on one end thereof. The padded roller is adapted to engage the back of the user at a position substantially in alignment with the shoulder blades and the other end of the lever is pivotally supported at a position in substantial alignment with the waist of the user. The other end of the user-actuated lever is operatively connected to weights. The connection between the user-actuated lever and the weights includes a variable radius cam for providing a variable resistance force to lifting and lowering the weights with corresponding movement of the user between a first position with the spine in a forwardly bent position and a second position with the spine in a substantially straight position to provide a full range exercising of the muscles associated with the lower back of the user.

U.S. Pat. No. 4,257,593 relates to an exercising device having a frame, a member borne by the frame for movement relative to the frame, a source of compressed gas, a reservoir having an internal chamber of adjustable capacity connecting in receiving relation to gas from the source, and an assembly interconnecting the member and the frame and connected to the reservoir for compression of a selected volume of gas in the internal chamber upon movement of the member relative to the frame.

US Patent Application Publication US 2014/0121071 A1 is concerned with an exercise machine comprising a frame and a weight stack. The weight stack may be positioned within a portion of the frame. The exercise machine may further comprise a weighted cable having a first end configured for selective attachment to weight plates of the weight stack, a guide track defining a path, and a movable pulley assembly coupled to the guide track. A positioning mechanism may be coupled to the movable pulley assembly and configured to move and position the movable pulley assembly along the path defined by the guide track. Additionally, the weighted cable may be routed through the movable pulley assembly.

A specific pneumatic exercise device that offers a range of adjustability and resistances so that a single piece of exercise equipment can be used to perform a number of different exercises and that produces generally constant resistance throughout the entire exercise stroke is disclosed in U.S. Pat. Nos. 7,955,235, 7,686,749 and 7,172,538, which disclose a compact pneumatic cylinder exercise apparatus that can be mounted to or supported by the floor, wall or other support structure, wherein a pulley wheel is rotatably connected to the piston rod and a cable is wrapped about at least a portion of the pulley wheel. While this machine is useful, it has been found to have certain deficiencies, one of which is that the user must initially set or fix the axis point, i.e., the point at which the cable's pulley height is determined. This limits the challenge to the user in the plane of motion. As such, improvements in these type devices are desired. Accordingly, the present invention has been made to overcome this deficiency and provide an improved exercise device that can provide more complete routines without requiring manual changes to the axis point or pneumatic resistance.

SUMMARY OF THE INVENTION

The present invention relates to an exercise device comprising a frame; a cable having first and second ends, with the first end provided with a user interface which may be a handle, an arm or leg band, a bar, or a seat; and a plurality of components that provide resistance to the cable and user interface. These components further include a carriage capable of movement between first and second positions and including one or more pulleys mounted thereon, wherein the cable extending away from the first end and user interface passes around the one or more pulleys on the carriage. The device includes means for driving the carriage back and forth between the first and second positions during an exercise.

The means for driving the carriage preferably comprises a motor and an elongated member with the carriage operatively associated with the elongated member for reciprocal movement thereon. Advantageously, the elongated member is cylindrical, the motor rotates the elongated member on its axis, the elongated member extends vertically in the frame and includes a spiral track thereon, and the carriage includes means for engaging the track. Thus, rotation of the elongated member in one direction raises the carriage while rotation of the elongated member in the opposite direction lowers the carriage, with the carriage and elongated member configured for vertical movement over a distance of 2 to 5 feet.

Another useful improved component of the invention is a slider mechanism that is moveable between first and second positions and including one or more pulleys mounted thereon. The slider mechanism is operatively associated with a pneumatic resistance device that is secured to the frame and that provides resistance to the movement of the slider mechanism between the first and second positions.

The pneumatic device comprises a piston and cylinder and the exercise device further comprises an accumulator affixed to the frame and operatively associated with the cylinder of the pneumatic device to reduce pressure increases therein as the piston is moved. The slider mechanism preferably moves vertically along a cylindrical rod that is affixed to the housing frame and the exercise device further comprises a linkage between the piston of the pneumatic device and the slider mechanism so that upward movement of the slider mechanism is inhibited by the pneumatic device.

To facilitate operation of the device, a pulley block arrangement is provided that includes one or more fixed and one or more vertically movable pulleys for increasing the tension on the cable, with the vertically movable pulley(s) of the pulley block arrangement connected to the slider mechanism by connection means. The connection means preferably comprises a separate cable or rod member such that the slider mechanism is configured for vertical movement over a distance of ¼ to 2 feet along the cylindrical rod. Preferably, the pulley block arrangement includes two fixed pulleys and two vertically movable pulleys and is also configured for vertical movement over a distance of ¼ to 2 feet. The device includes a plurality of pulleys fixed to the frame for guiding the cable extending away from the carriage pulley(s) to the pulley block arrangement and back to the carriage wherein the second end of the cable is affixed to the carriage.

The exercise device also preferably includes a computer controller for programming of an exercise routine, wherein the user is able to set parameters including at least an amount of resistance provided by the pneumatic device, and the speed of travel of the carriage.

BRIEF DESCRIPTION OF THE DRAWINGS

The foregoing and other features, aspects and advantages of the present invention will now be described with reference to the drawings of preferred embodiments, which are intended to illustrate and not to limit the present invention, and wherein.

DETAILED DESCRIPTION OF THE INVENTION

Figure 1:
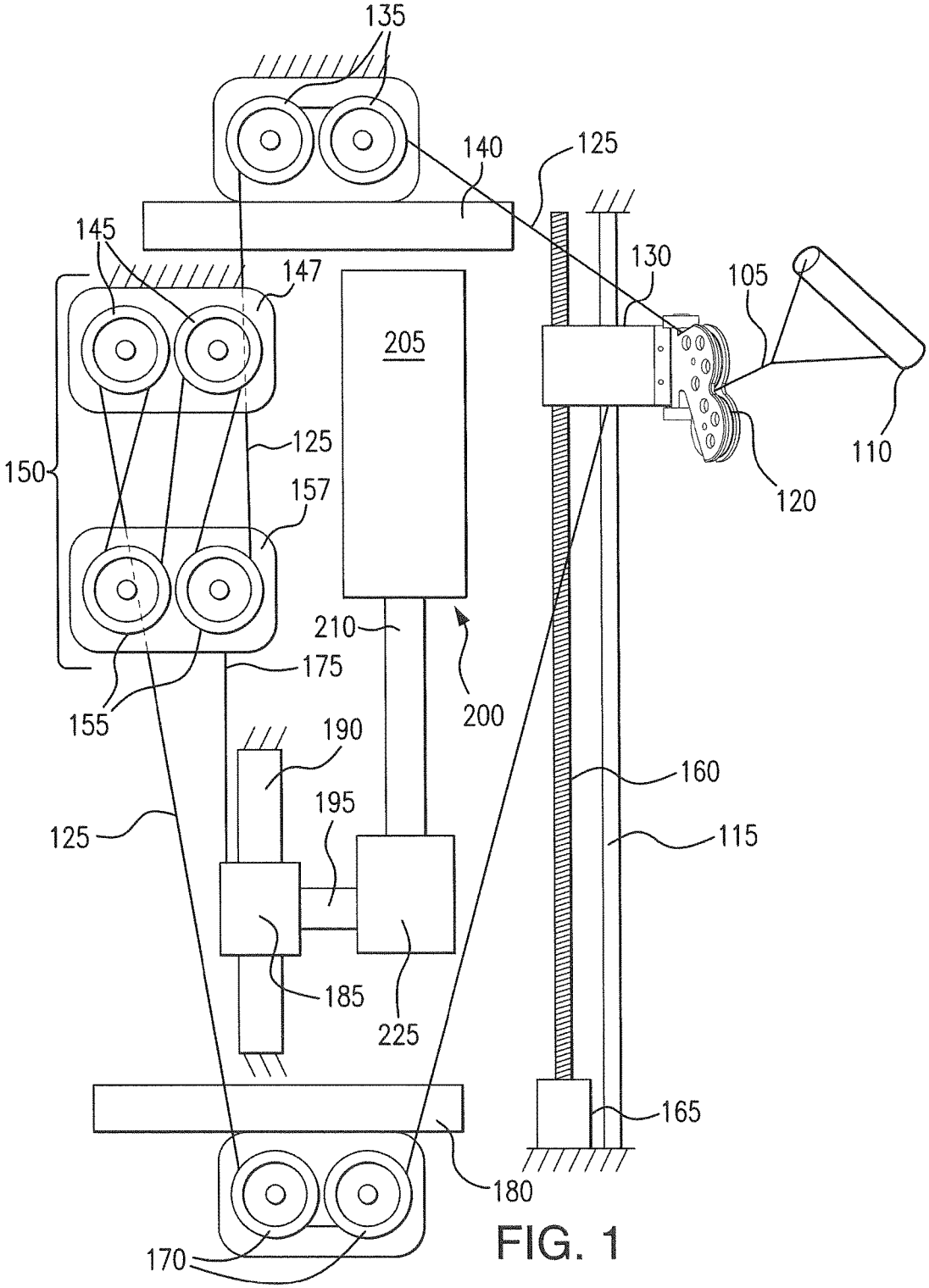
FIG. 1 is a schematic view of the exercise device of the present invention to illustrate the interaction and operation of the various components therein.

The following definitions set forth the parameters of the present invention.

As used herein, the term "longitudinal" refers to the running lengthwise rather than across the width of a material, whereas "vertical" refers to the running in the direction of the force of gravity.

As used herein, the term "tension" refers to a pulling force exerted by each end of a string, cable, chain, or a similar one-dimensional continuous object.

As used herein, the term "pulley" refers to a wheel system on an axis that is designed to support movement and change of direction of a cable along its circumference.

As used herein, the term "pneumatic cylinder" refers to mechanical devices, which use the power of compressed gas such as but not limited to air to produce a force in a reciprocating linear motion.

As used herein, the term "accumulator" refers to a container, which stores pressurized air for release into the pneumatic cylinder via an air equalization line.

As used herein, the term "actuator" refers to a type of motor that is responsible for moving or controlling a mechanism or system. It is operated by pneumatic pressure.

As used herein, the term "motor" refers to a device that is able to create motion.

As used herein, the term "cable" collectively refers to steel or fiber, rope, cord, or the like.

As used herein, the term "radial motion" refers to movement of an object along the circumference of a circle or rotation along a circular path.

As used herein, the term "screw" refers to a vertical pole, which comprises a 20 mm×20 mm pitch such that the "screw" starts rotating, as the motion from the motor is directly transferred to the "screw". As the "screw" rotates, the radial motion is transferred to linear motion along a linear track.

As used herein, the term "user interface" refers to a handle that is movable between a retracted position and extended position.

As used herein, the term "reciprocation" is a repetitive up-and-down or back-and-forth linear motion. The two opposite motions that comprise a single reciprocation cycle are called strokes.

As used herein, the term "piston" refers to a component capable of performing a reciprocating movement. It is the moving component that is contained by a cylinder.

As used herein, the term "resistance" refers to a force with an opposing direction and motion.

As used herein, the term "retracted" refers to the shrinking, whereas the term "extended" refers to the enlargement.

As used herein, the term "axis point" is used interchangeably with a "movable pulley system".

As used herein, the terms "movable pulley assembly" mounted on the "linear track block" is also known to interchangeably reflect the term "screw housing adapter assembly", which includes the "movable pulley assembly" mounted on the "linear track block" in direct horizontal operative extension and communication with a ball-nut top and a ball-nut lower housing.

The present invention is an exercise device that is improved over the device disclosed in U.S. Pat. No. 7,955,235 (the '235 patent) but shares some common features, such that the entire content of that patent is expressly incorporated herein by reference thereto.

The present exercise apparatus includes a pneumatic resistance unit that allows for constant or variable resistance and variable degrees and extensions of motion by the user. In addition, the resistance unit is operatively associated with a carriage engaged with the user interface. The movement of the carriage is programmable and can vary depending upon the desired exercise routine. The combination is designed to permit the user to perform a wide variety of exercises to work various muscles or muscle groups without having to modify the equipment or user's working position. As will be apparent from the following description of the preferred embodiments, the carriage is movable but the pneumatic resistance unit can be stationary or movable. The device can include movable pulleys that allow the user to change the direction in which the user pushes or pulls during a set of the exercise repetitions. The resistance unit is preferably provided in the device for use as a stationary exercise apparatus.

One of the major goals and obvious advantages of the exercise apparatus over all other pulley pieces and exercise apparatus that are currently available is the incorporation of programmed motion-profiles affording continuous motion and movement of the movable pulley system during the duration of the exercise.

The pulley system moves during the actual pull or press of the handle, while the cable is under the programmed tension of resistance. During the range of motion, there must be appropriate changes in the allowed length of the cable to off-set the changing axis point.

This programmed change of the pulley system, which takes place virtually in a vertical direction on the vertical track of the exercise apparatus, advantageously forces the exercising user to incorporate, challenge and train all stabilizing muscle groups throughout the whole body, while at the same time, training multiple muscle groups for more than just a strength training exercise.

Another benefit of the exercise apparatus is to constantly force the central nervous system to adapt and change how it stabilizes the body during the exercise.

The illustrated embodiments include a pneumatic resistance unit that allows for constant or variable resistance and variable degrees and extensions of motion by the user. Similarly, the exercise apparatus of the present invention easily allows the user to perform a wide variety of exercises that provide the exerciser to work various muscles or muscle groups with the same piece of equipment.

As in the '235 patent, the resistance unit (i.e., power module) forms an exercise apparatus that can be mounted to a support structure, such as a wall, a frame or a post. The resistance unit is operatively associated with the user interface, which the user grips, the movable carriage, and a pulley block and tackle arrangement (pulley block) that helps provides a range of movement to the user interface. A frame supports all components and a cover is provided to prevent inadvertent contact with the moving components by the user.

The user interface takes the form of a handle, but it can instead be a band (preferably of an adjustable size) that is sized to fit around a portion of the user's body, e.g., a waistband or an ankle band. The user interface additionally can be a bar, a foot pedal, movable seat or other movable or lifting equipment. The user interface thus can be any article or mechanism that a user acts against or interacts with and that is attached, either directly or indirectly, to the cable.

As in the '235 patent, the user interface preferably moves between two positions during an exercise and is engaged with a carriage that can be programmed to move from one extreme position to another extreme position. The handle normally resides in a retracted position with the cable end to which the handle is attached being fully retracted up to the unit. A user can move the handle from the retracted position to an extended position in which the cable end is pulled to its farthest position from the surrounding housing. The exercise movement can involve movement between any two positions between (and possibly including) the retracted and extended positions in order to accommodate different exercises and different size weight lifters.

The present invention incorporates many of the features of the '235 patent. One significant modification that has been made is the provision of the programmable, movable carriage that includes one or more pulleys for engaging a cable that is connected to the user interface. Yet another modification is the use of a slider mechanism that is engaged with the piston of the pneumatic device and the pulley block to provide resistance to the cable and user interface.

As used herein, "cable," means collectively, steel or fiber rope, cord, or the like. For example, the user cable can be a formed of a synthetic material, such as a polymer. One suitable material for the user cable is a polyester/nylon blend rope; however, a coated steel cable can also be used. For example, the user cable can comprises ⅛ inch wire cable with a plastic sheathing, and most of the pulleys of the unit that support the cable can have a diameter of about five inches. Although any suitable cable and pulley size can be employed, it is preferable that the associated pulleys have a diameter about 40 times the diameter of the coated-wire cable. Smaller diameter pulleys, however, can be used with other types of cables, e.g., 3.5-inch diameter pulleys used with polyester/nylon blend rope.

Figure 2:
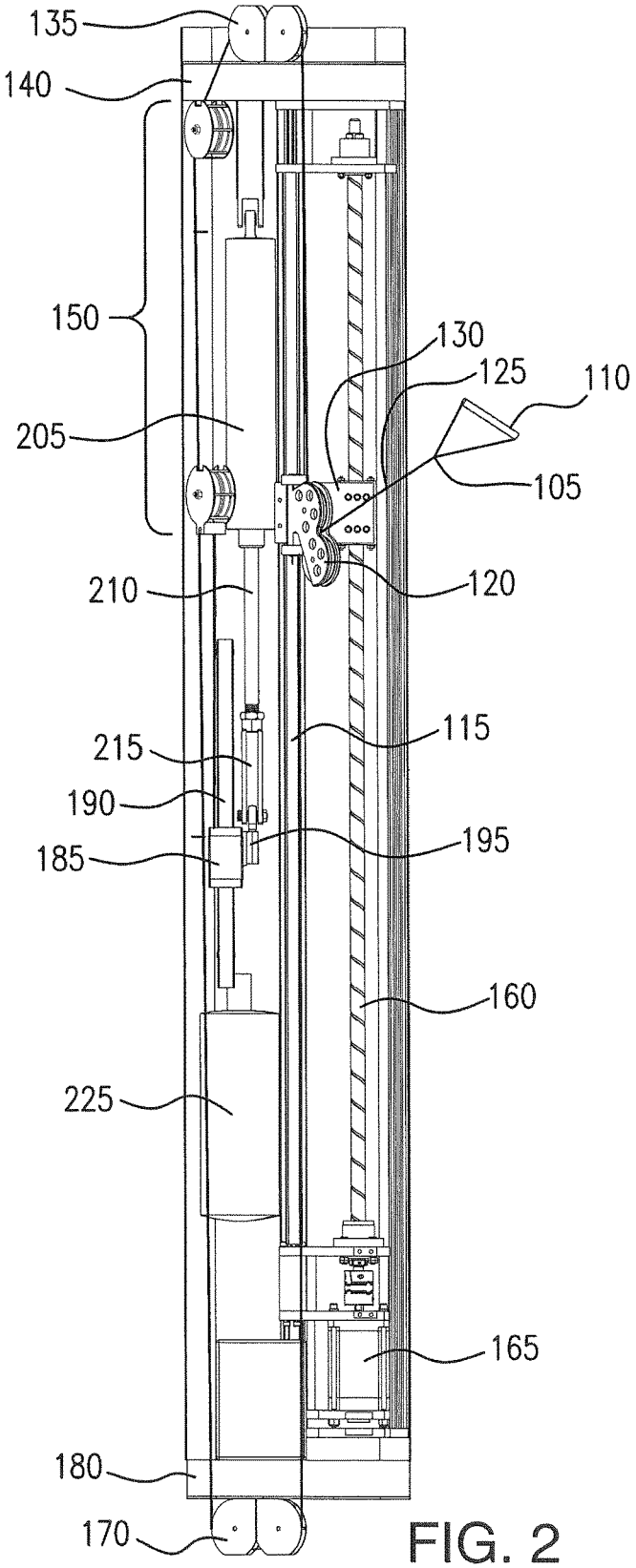
FIG. 2 is a side view of the exercise device of the present invention.
Figure 3:
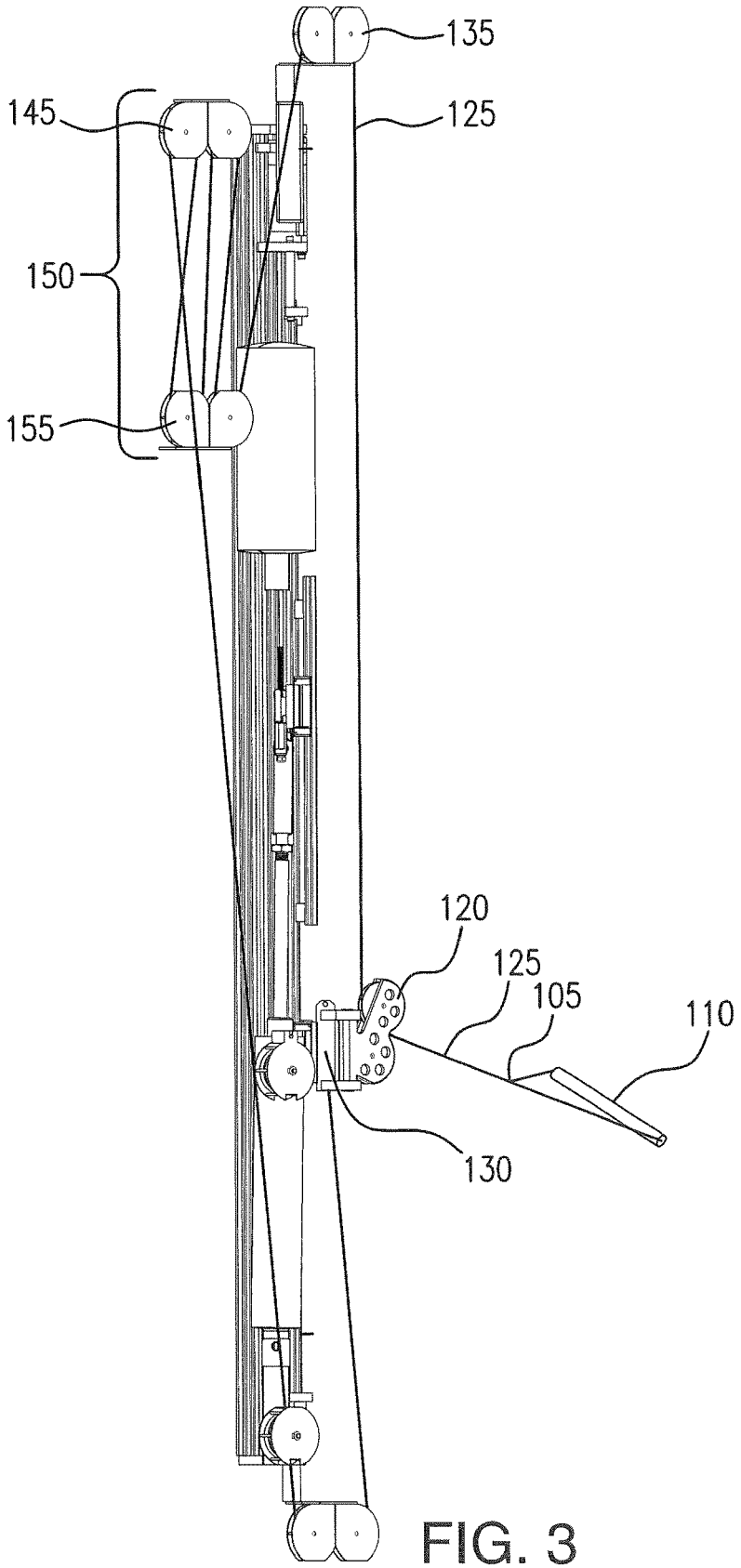
FIG. 3 is a rear view of the exercise device of the present invention.

The exercise device 100 is shown schematically in FIG. 1, while FIGS. 2 and 3 illustrate the arrangement of the components in a frame. The first end 105 of the user cable 125 begins at a user interface 110, which typically is a handle. The cable then passes through one or more pulleys 120 that are mounted on a vertically movable carriage 130. The handle 110 preferably is releasably connected to the end of the user cable in order to exchange different types of user interface. The arrangement of the carriage 130 and pulleys 120 automatically align the user cable when the handle 110 is pulled from substantially any direction outwardly from the unit. Thereafter the user cable 125 continues into the device and through one or more fixed pulleys located 135 on an upper portion 140 of the frame. From there, the user cable then is wound around the pulley block arrangement 150 by passing between upper fixed pulleys 145 and lower movable pulleys 155, each of which is present in a pulley block 147, 157.

The cable adjacent the user interface passes through the pulleys of the vertically movable carriage before being connected to other pulleys in the device. The pulleys on the movable carriage can be considered to be in a fixed position when no force is applied, such as just before beginning and exercise routine. In the '235 patent, these pulleys are mounted on a carriage that is fixed at a particular vertical position. In contrast, in the present invention, the carriage is arranged to be movable between various vertical positions and can be programmed to provide the desired movement distance and time during a selected exercise routine.

The movable carriage 130 is mounted on an elongated member 115 and is driven upwardly and downwardly along that member by a second elongated member 160 which is preferably a cylindrical rod that includes a spiral track. The carriage 130 includes rollers or other means such as a cam that allows the carriage 130 to engage the track of the rod 160 for vertical movement. Elongated member 115, typically a pole or smooth rod, is attached to the frame and prevents the carriage from lateral movement due to the forces imparted on it by the user handle. The carriage 130 can include ball bearings or other appropriate means to facilitate sliding motion along pole 115.

The rod 160 is rotated about its axis either clockwise or counterclockwise by a motor 165 to move the carriage upwardly or downwardly between the selected vertical positions after the exercise routine is initiated. The carriage can move as much as 6 feet or almost the entire height of the device frame although in some cases it will preferably move between about 2 and 4 feet and typically about 3 feet to provide the desired exercise challenge to the user.

From the carriage 130, the cable then passes through one or more fixed pulleys 135 located at the top of the device frame. Thereafter, the cable 125 passes through a pulley block arrangement 150 that is capable of providing resistive forces. The pulley block arrangement includes an upper pulley block 147 that is fixed to the device frame and a lower pulley block 157 that is free to move back-and-forth vertically. The lower pulley block 157 is capable of movement up or down over a distance of 6 inches to 3 feet although a preferred distance is approximately 12 inches. The user can select the amount of force to be provided by the pulley block arrangement which in turn will control the amount of movement of the lower pulleys.

Each pulley block of the pulley block arrangement 150 includes at least two pulleys, but each block can include fewer or more pulleys. The upper pulley block 147 is attached to upper cross member or bracket of the device frame. The user cable 125 extends upward inside the housing from one of the bottom pulleys 155 and wraps around one of the upper pulleys 145. The user cable 125 then extends down and wraps around another one of the lower pulleys 155, and then up and down again wrapping around another upper pulley 145. Accordingly, as the user pulls the user cable 125 from the unit (i.e., pulls the cable towards the user), the pulley block arrangement 150 shortens in the process as the lower pulley block 155 is moved upward toward the upper pulley block 145.

After the cable 125 leaves the pulley block arrangement 150 it runs through the back of the machine to one or more fixed pulleys 170 near the bottom 180 of the device frame. After passing through those pulleys 170, the cable terminates at its second end at a connection to the vertically moveable carriage.

The lower pulley block 157 constitutes an output member of the pulley block arrangement 150. In other words, the load to be "lifted" is connected to lower pulley block 157. One end of a main cable 175 is attached to the lower pulley block 157 while the other end is fixed to the slider mechanism 185. The main cable 175 cooperates with the pneumatic device 200 so that as the user pulls the handle 110, the user cable 125 winds through the pulley blocks lifting the lower pulley block 157 and correspondingly pulling on the main cable 175. Force from the pneumatic device 200 is communicated through the main cable 175 to the lower pulley block 157 and further to the user cable 125.

As shown, the pulley block arrangement 150 includes four pulleys and four lengths of line between the pulleys. As such, the resultant force at the handle is one-fourth of the force supplied by the pneumatic device, and the stroke length of handle is about four times the stroke length of the pulley block output (i.e., the distance of between upper and lower pulley blocks when the handle is in the retracted position). The relative movement of the lower pulleys is about one foot, which is approximately the same as the movement of the slider mechanism. Of course, any pulley assembly can be used to achieve any desired force reduction or stroke elongation and these distances can be changed accordingly.

The pneumatic device 200 includes a pneumatic actuator that is a linear actuator that includes a cylinder 205 and a piston rod 210. The cylinder includes a cylinder body and a piston that slides within the cylinder body. The piston divides the cylinder body into two variably volume chambers. At least one of the chambers only selectively communicates with the atmosphere so as to provide the desired resistance. The other chamber can be open to the atmosphere; however, in some applications, both chambers can be pressurized (e.g., be of equal pressure), can selectively communicate with the atmosphere and/or can communicate with each other. One of the chambers preferably communicates with the atmosphere (e.g., the air within the housing) so as not to resist movement of the piston.

The piston rod 210 extends through one of the variable volume chambers. The piston rod moves linearly along a stroke axis as the piston slides within the bore of the cylinder 205. The stroke length of the piston rod is sufficient to provide the desired stroke for the pulley block arrangement 150.

The frame includes a guidepost 190 that supports the slider mechanism 185 that is configured to slide over the guidepost 190. The slider mechanism has a corresponding tubular shape and is sized to slip over the guidepost. In this manner, the slider mechanism can be moved vertically over the guidepost.

The slider mechanism 185 is designed to achieve sliding vertical movement up or down over a distance of about 12 inches along the rod 190. The slider mechanism 185 is fixedly attached to the end 215 of the piston 210 from the pneumatic cylinder 205 such that the cylinder provides a resistive force against the upward movement of the slider mechanism. The user can select the desired resistive force when initially programming the exercise machine to carry out a desired routine.

The slider mechanism 185 is configured to slide upwardly and downwardly along the guidepost 190. In a preferred embodiment, the guidepost is oriented vertically with the slider mechanism including means to facilitate reciprocal sliding motion along the guidepost which is securely fixed to the frame of the housing.

The slider mechanism 185 is connected to the piston end 215 of the pneumatic cylinder through a secure linkage 195. The pneumatic cylinder 205 provides the selected resistive force to hinder the movement of the slider mechanism. This force, in turn, is imparted to the lower, freely movable pulleys of the lower pulley block 157.

Generally, the movement of the slider mechanism is over a distance of about 10 to 20 inches and is preferably around 12 inches between the lowest and highest vertical positions. A cap closes the opposite end of the cylinder body (i.e., opposite of the end through which the piston rod extends). The cap includes a lug. A pivot pin preferably secures the lug to the cylinder-mounting bar such that the pneumatic actuator can pivot within the housing about the pivot pin. The pneumatic actuator in the illustrated embodiment hangs from the bar within the housing so as to pivot within a plane that is generally parallel to the front side of the housing; however, in some applications, the cylinder body can be rigidly fixed within the housing. The actuator in this position thus has an upper chamber and a lower chamber. The lower chamber is open to the atmosphere (preferably through a filter) and the upper chamber is pressurized.

At least several components of the pneumatic cylinder are preferably formed of a polymer (e.g., plastic) in order to lighten the weight of the resistance unit and to decrease production costs. Such components can include the cylinder body, the piston and one or more of the end caps of the cylinder.

The upper chamber of the cylinder preferably communicates with at least one accumulator. The accumulator is (preferably rigidly mounted within the housing at a location next to the cylinder. The accumulator is mounted on one side of the cylinder and the pulley block arrangement is disposed on the other side of the cylinder within the housing. An air equalization line connects the accumulator with the cylinder so as to expand effectively the variable volume of the upper chamber. In this manner, the effective air volume of the cylinder is increased, and air pressure thus will not increase as dramatically when the piston is moved.

The accumulator and the upper chamber also selectively communicate with a source of pressurized air and with the atmosphere. In the illustrated example, an air compressor, which can be remotely disposed relative to the exercise apparatus, communicates with the upper chamber through an inlet valve. A button that actuates the inlet valve preferably is accessible from the front side of the housing and is marked with appropriate indicia (e.g., "+"). Pushing the button adds air pressure to the charged side of the cylinder, e.g., the upper chamber in the illustrated embodiment. An outlet valve communicates with the charged side of the cylinder to selectively expel air to the atmosphere in order to decrease air pressure on the charged side of the cylinder. A button that actuates the outlet valve also is preferably accessible from the front side of housing and is marked with appropriate indicia (e.g., "−"). A user thus can adjust, i.e., increase or decrease, the air pressure within the resistance assembly by operating the appropriate valves.

The cable transfers a resistant force from the pneumatic device to oppose movement of the handle by the user. As noted above, the separate cable includes a ball swaged onto the first end. The ball fits through a keyway slot formed in the lower pulley block and nests in a receptacle. The receptacle/ball connection secures the first end of the cable to the lower pulley block, yet allows the cable to pivot relative to the pulley block.

The pneumatic actuator 200 is arranged such that its stroke axis lies generally parallel to the first section of main cable at least initially when the handle is in its retracted position. The resistance unit can be readily used in a variety of applications, as it is also lightweight and involves relative few components, yet provides a full range of movement. It this provides versatility in the types of exercises that can be performed, and variability in the amount of resistance provided.

As the piston 210 moves within the cylinder 205, the resistance force will increase somewhat, although not as dramatic as it would without the accumulator 225. For some exercises, it is preferred that the resistance force be maintained at a generally constant level throughout the exercise stroke (e.g., the cable tension remains generally constant). As discussed below, the illustrated embodiment comprises a mechanism for controlling the resistance force over the stroke of the piston rod; however, the resistance unit need not include such a mechanism in all applications.

Additionally, as the cable engages and is threaded through the pulleys on the vertically movable carriage, the movement of the carriage provides a varying axis point that continuously moves through a range of motion during a preselected time interval so that the reference point of tension changes during the exercise routine, thus causing the user to continuously adjust their balance and control when performing the exercise. This challenges and requires a response by different muscles or muscle groups to enhance the workout. The movement of the carriage along with the movement of the slider mechanism provides consistent resistance through the entire exercise routine.

The cable 125 leaving the lower pulley block 157 is operatively associated with the fixed pulleys 170 that are located on the lower portion of the frame of the device. The cable continues back to the carriage 130 where the second end of the cable is attached to the carriage 130.

The present invention provides a number of unexpected advantages over prior art devices. Instead of the axis point being fixed in a single position, the axis point is continuously moving throughout the exercise program between higher and lower vertical positions. The user will program into the machine the range of distance traveled between the two vertical points (e.g., the highest and lowest points for the pulley cable) to determine the positions where the cable will come out of the device, along with the speed it will take to move the cable trolley between those two points. Also, the user sets the desired resistance of the cable that is provided by the pneumatic device.

By providing a movable axis point, a more difficult exercise routine is encountered that helps the user burn more calories and/or build muscle mass faster. The greatest benefit of this arrangement and reciprocal upward and downward movement of the user interface and first end of the cable, however, is that it constantly forces the central nervous system to adapt and change how it stabilizes the body during the exercise. This change in axis point forces the user to incorporate all stabilizing muscle groups in the body while challenging multiple, sometimes changing muscle groups for more than just a strength training exercise. Additionally, the exercise routine becomes one or a combination of a neuromuscular challenge, a stabilizing challenge, a balance challenge, a power challenge, a stepped challenge and a range of motion challenge.

The exercise device of the invention also includes a display panel that provides options to the user to determine and preselect at least the following variables for a particular exercise routine:

- the amount of resistance to be used, typically in pounds of pressure;
- the range of motion of the carriage on the elongated member, in feet, of the distance that the axis point can travel during the duration of the exercise; and
- the rate of speed for movement of the carriage through the range of motion (i.e., the distance of travel), in seconds.

The variables are selected from selection buttons that are provided on the device that become active when an exercise routine is to be programmed, or on a display screen that provides a selection menu for the user to enter data for the variables that are to be applied during the exercise routine.

After the variables as selected, a START button is pressed and the device continues to operate until no movement of the user interface is determined over a time period of 5 to 10 seconds. For example, resistance can be selected in 5 or 10 pound increments, and the rate of speed can be from 0.5 to 5 seconds in half second increments.

In sum, it is to be understood and realized that the optimum dimensional relationships for the parts of the invention to include variations in size, materials, shape, form, function and use are deemed readily apparent and obvious to the skilled artisan, and all equivalent relationships to those illustrated in the drawings and described in the specification are intended to be encompassed by the present invention.

Unless defined otherwise, all technical and scientific terms used herein have same meaning as commonly understood by the person of ordinary skill in the art to which this invention belongs. As used herein and in the appended claims, the singular form "a", "and", and "the" include plural referents unless the context clearly dictates otherwise. All technical and scientific terms used herein have the same meaning. Thus the scope of the embodiments of the present invention should be determined by the appended claims and their legal equivalents rather than by the Figures.

Further since numerous modifications and changes will readily be apparent to those having ordinary skill in the art, it is not desired to limit the invention to the exact constructions as specifically demonstrated in this disclosure. Accordingly all suitable modifications and equivalents may be resorted to falling within the scope of the invention. Thus it should be understood that various features and aspects of the disclosed of the disclosed embodiments can be combined with or substituted for one another in order to form varying modes of the disclosed invention.

What is claimed is:

1. An exercise device comprising:

a frame;

a carriage engaged with the frame capable of movement between first and second positions and including one or more pulleys mounted thereon;

a cable having first and second ends, with the first end provided with a user interface, wherein the cable extends away from the first end and the user interface and passes around the one or more pulleys and defines an axis point at the one or more pulleys;

a motor for continuously driving the carriage back and forth relative to the frame between the first and second positions of the carriage to continuously move the axis point between first and second positions during exercise; and a computer controller for programming a programmed exercise routine, wherein the programmed exercise routine includes preselected user is able to set parameters including at least the travel distance of the carriage between the first and second positions, and wherein the carriage is continuously driven back and forth relative to the frame between the preselected first and second positions during exercise according to the programmed exercise routine.

2. The exercise device of claim 1 further including: a slider mechanism moveable between first and second positions; a pneumatic resistance device secured to the frame and operatively associated with the slider mechanism to provide resistance to movement of the slider mechanism between the first and second positions of the slider mechanism.

3. The exercise device of claim 1 wherein the user interface is a handle, an arm or leg band, a bar, or a seat.

4. The exercise device of claim 1 further comprising an elongated member with the carriage operatively associated with the elongated member for back and forth movement thereon.

5. The exercise device of claim 4 wherein the elongated member is cylindrical and is rotatable in either direction along its axis by the motor, the elongated member includes a spiral track thereon, and the carriage engages the track such that rotation of the elongated member in one direction raises the carriage while rotation of the elongated member in the opposite direction lowers the carriage.

6. The exercise device of claim 5 wherein the carriage and elongated member are configured for vertical movement of the carriage over a distance of 2 to 5 feet.

7. The exercise device of claim 1 wherein the pneumatic device comprises a piston and cylinder and the exercise device further comprises an accumulator affixed to the frame and operatively associated with the cylinder of the pneumatic device to reduce pressure increases therein as the piston is moved.

8. The exercise device of claim 7 wherein a slider mechanism moves vertically along a cylindrical rod that is affixed to the housing frame and the exercise device further comprises a linkage between the piston of the pneumatic device and the slider mechanism so that upward movement of the slider mechanism is inhibited by the pneumatic device.

9. The exercise device of claim 8 further comprising a pulley block arrangement that includes one or more fixed and one or more vertically movable pulleys for increasing the tension on the cable, with the vertically movable pulley(s) of the pulley block arrangement connected to the slider mechanism.

10. The exercise device of claim 9 wherein the vertically movable pulley(s) of the pulley block arrangement connected to the slider mechanism by a separate cable or rod member wherein the slider mechanism is configured for vertical movement of the sliding mechanism over a distance of ½ to 2 feet along the cylindrical rod, and the pulley block arrangement includes two fixed pulleys and two vertically movable pulleys and is also configured for vertical movement over a distance of ½ to 2 feet.

11. The exercise device of claim 10, further comprising a plurality of pulleys fixed to the frame for guiding the cable extending away from the carriage pulley(s) to the pulley block arrangement and back to the carriage wherein the second end of the cable is affixed to the carriage.

12. The exercise device of claim 11, wherein the preselected parameters further include an amount of resistance provided by the pneumatic device.

13. The exercise device of claim 1 further comprising a button to start the motor to continuously move the axis point between the first and second positions of the axis point during exercise.

14. The exercise device of claim 1, wherein the preselected parameters further include a rate of speed for continuous movement of the carriage between the first and second positions, and wherein the carriage is continuously driven back and forth relative to the frame between the preselected first and second positions at the preselected rate of speed during exercise according to a programmed exercise routine.

15. The exercise device of claim 1 wherein the frame includes a rod, the carriage engaged with the rod and the motor rotating the rod for continuously driving the carriage back and forth relative to the frame between the first and second positions of the carriage to continuously move the axis point between first and second positions during exercise.

16. The exercise device of claim 15 wherein the rod includes a spiral track.

* * * * *